US012622515B1

(12) United States Patent
Hammond

(10) Patent No.: US 12,622,515 B1
(45) Date of Patent: May 12, 2026

(54) ROTARY STORAGE ORGANIZER

(71) Applicant: Shari Michelle Hammond, Georgetown, TX (US)

(72) Inventor: Shari Michelle Hammond, Georgetown, TX (US)

(73) Assignee: Aacraft Inc., Georgetown, TX (US)

( * ) Notice: Subject to any disclaimer, the term of this patent is extended or adjusted under 35 U.S.C. 154(b) by 0 days.

(21) Appl. No.: 18/773,240

(22) Filed: Jul. 15, 2024

Related U.S. Application Data

(60) Provisional application No. 63/527,202, filed on Jul. 17, 2023.

(51) Int. Cl.
*A47B 49/00* (2006.01)

(52) U.S. Cl.
CPC ..... *A47B 49/00* (2013.01)

(58) Field of Classification Search
CPC ..... A47B 49/00; A47B 49/004; A47B 49/006; A47B 2063/005; A47B 2088/401; A47B 88/48; A47F 3/10; A47F 5/0037; A47F 5/02
USPC ..... 211/144, 163, 77, 78, 74
See application file for complete search history.

(56) References Cited

U.S. PATENT DOCUMENTS 2,453,667 A * 11/1948 Lambert ..... F25D 11/00 211/74
2,840,438 A * 6/1958 Sharpe ..... F25D 25/027 211/144
2,936,205 A * 5/1960 Clark ..... A47B 49/004 D15/89
3,868,157 A * 2/1975 Robinson ..... A47B 49/004 312/286
4,124,262 A * 11/1978 Schill ..... A47B 49/004 312/307
4,140,223 A * 2/1979 Rau ..... A47F 3/10 D7/600
4,241,964 A * 12/1980 Grubb, Jr. ..... A47B 63/062 312/286
4,560,064 A * 12/1985 Peterson ..... A47G 23/0266 206/427
4,582,372 A * 4/1986 Cooper ..... A47B 81/002 312/307
4,889,245 A * 12/1989 Rinke ..... B65D 71/50 211/49.1
5,024,168 A * 6/1991 Stravitz ..... A47B 49/004 108/94
5,183,165 A * 2/1993 Acona ..... A47B 73/00 211/74
5,487,599 A * 1/1996 Weisburn ..... A47B 87/02 211/163
5,641,080 A * 6/1997 Humphrey ..... A47B 49/004 211/163
6,481,586 B1 * 11/2002 Hoff ..... A47B 57/26 211/90.02
7,090,316 B2 * 8/2006 Model ..... A47B 88/60 312/328
7,758,005 B2 * 7/2010 Uemura ..... H04N 5/64 248/346.06
8,348,069 B2 * 1/2013 Roach ..... A47B 49/004 211/77

(Continued)

*Primary Examiner* — Daniel J Troy
(74) *Attorney, Agent, or Firm* — G. Michael Roebuck; The Moster Law Firm

(57) ABSTRACT

A rotary storage organizer that fits inside a cabinet and rotates to allow access to a front and back of a storage shelf.

15 Claims, 9 Drawing Sheets

(56) References Cited

U.S. PATENT DOCUMENTS

| | | | | |
|---|---|---|---|---|
| 8,511,487 | B2 * | 8/2013 | Andersen | A47F 1/12 211/144 |
| 8,985,347 | B2 * | 3/2015 | Thompson | A47J 47/16 211/74 |
| 10,443,923 | B2 * | 10/2019 | Jeon | F25D 23/025 |
| 11,083,312 | B2 * | 8/2021 | Bersagel | A47B 49/004 |
| 11,209,208 | B2 * | 12/2021 | Rehage | F25D 25/027 |
| 11,333,430 | B2 * | 5/2022 | Rehage | F25D 25/027 |
| 11,946,687 | B1 * | 4/2024 | Fan | F25D 23/028 |
| 12,075,911 | B2 * | 9/2024 | Rehage | A47B 96/025 |
| 12,127,672 | B2 * | 10/2024 | Hammond | A47B 88/48 |
| 2007/0272629 | A1 * | 11/2007 | Spirer | B42F 7/145 211/10 |
| 2009/0223915 | A1 * | 9/2009 | Thompson | A47B 61/04 211/144 |
| 2012/0298604 | A1 * | 11/2012 | Fuhrer | A47B 77/16 211/163 |

* cited by examiner

SECTION A-A

FIG. 9A
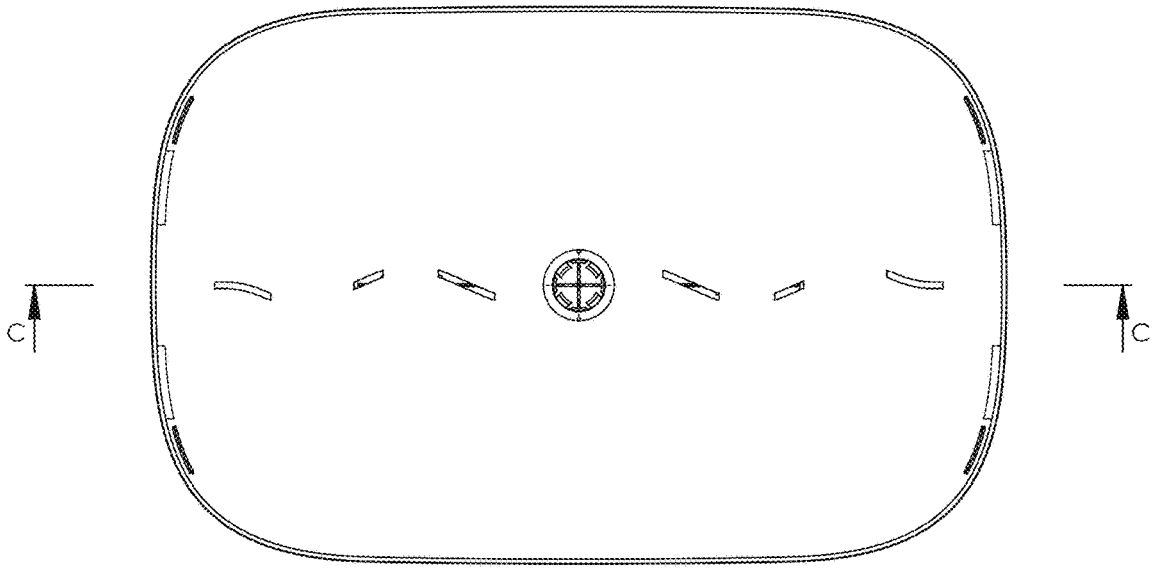
FIG. 9B
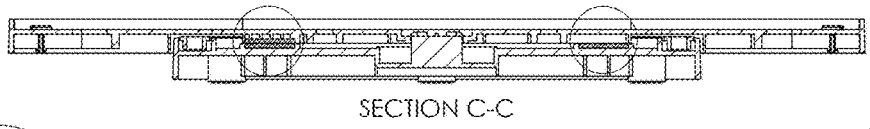
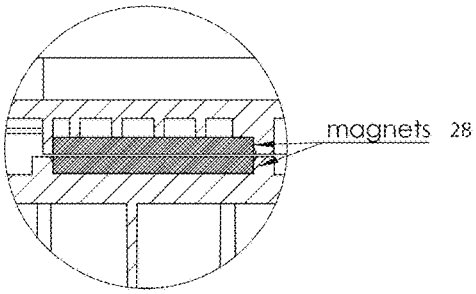
FIG. 9C
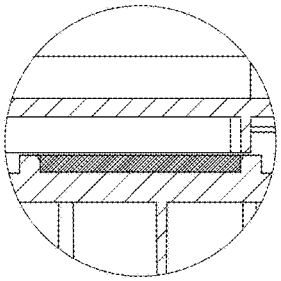
FIG. 9D

FIG. 11A
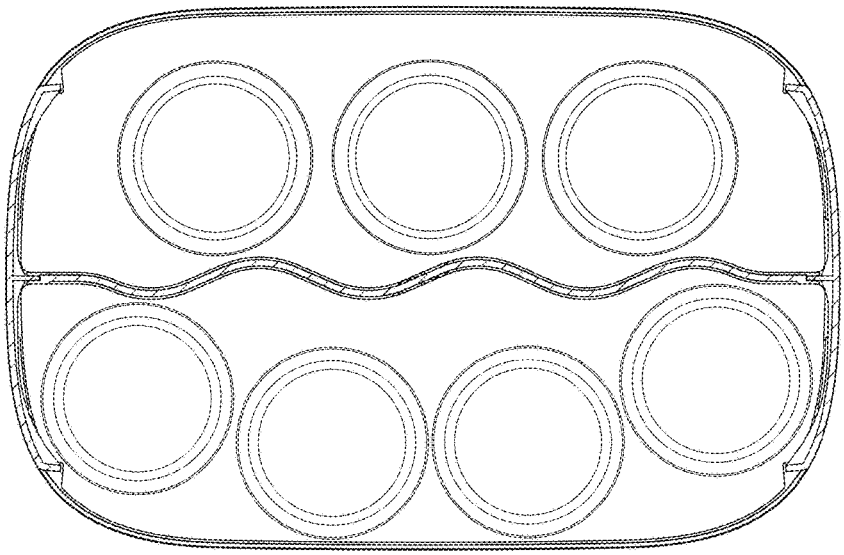
SECTION B-B
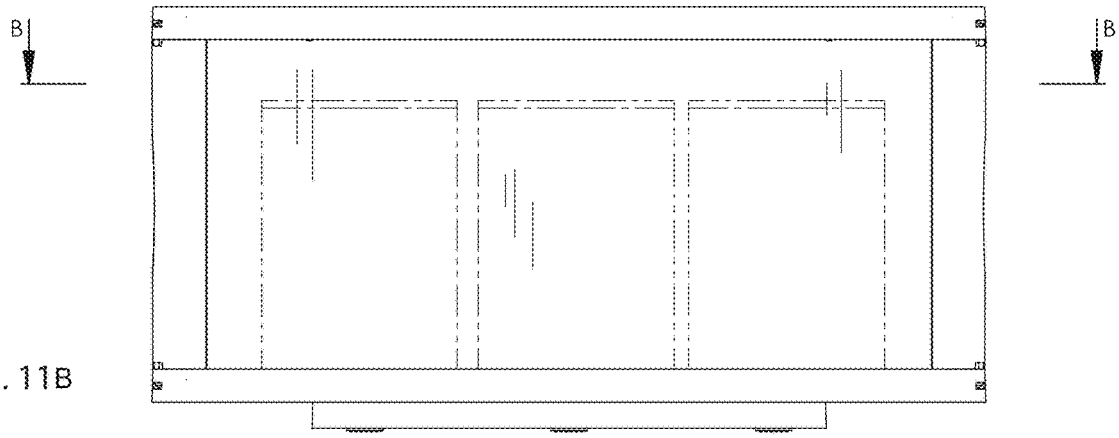
Fig. 11B

FIG. 13A
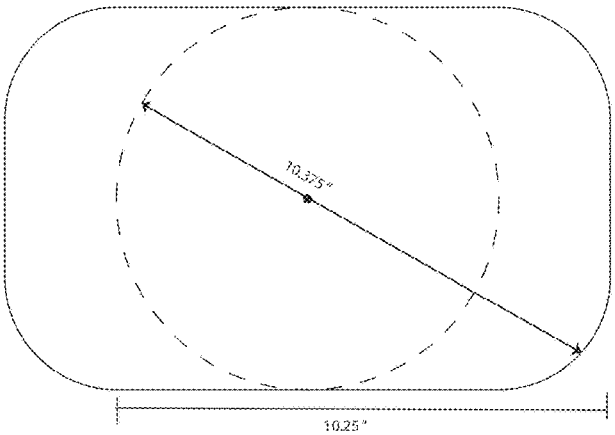
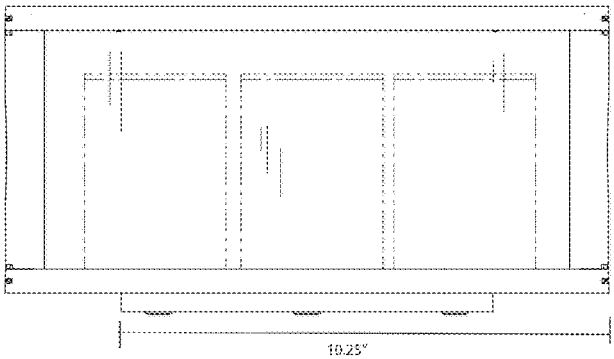
FIG. 13F
FIG. 13B
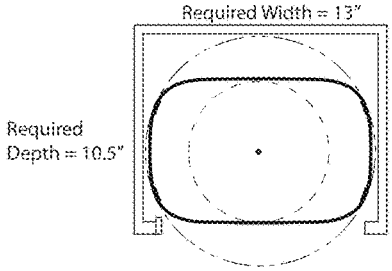
FIG. 13C
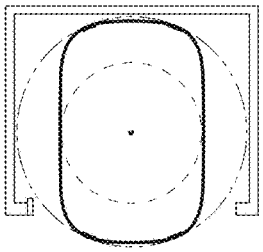
FIG. 13D
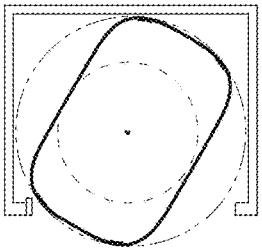
FIG. 13 E

ROTARY STORAGE ORGANIZER

CROSS REFERENCE TO RELATED PATENT APPLICATIONS

This patent application claims priority from U.S. Provisional patent application Ser. No. 63/527,202, filed on Jul. 17, 2023, by Hammond and entitled "A Rotary Storage Organizer," which is hereby incorporated by reference in its entirety.

BACKGROUND OF THE INVENTION

There is a need for an efficient canned goods storage organizer.

FIELD OF THE INVENTION

The present invention relates to the field of canned good storage.

BRIEF DESCRIPTION OF THE DRAWINGS

The drawings are drawn to scale.

FIGS. 9A, 9B, 9C and 9D show a section view of bottom shelf magnet placement in a particular illustrative embodiment of the invention;

FIGS. 11A and 11B show a section BB view of possible can storage positions in a particular illustrative embodiment of the invention; and FIGS. 12A, 12B, 12C, 12D, 12E and 12F and FIGS. 13A, 13B, 13C, 13D, 13E and 13F show storage unit rotating inside cabinet of the invention in a particular illustrative embodiment of the invention.

SUMMARY OF THE INVENTION

A rotary storage shelf that fits inside a cabinet and rotates to allow access to a front and back of a storage shelf.

DETAILED DESCRIPTION OF AN ILLUSTRATIVE EMBODIMENT OF THE INVENTION

Figure 1:
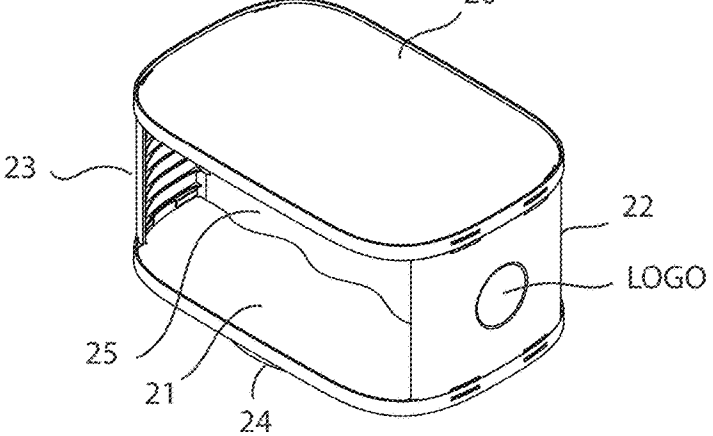
FIG. 1 shows an isometric view of a particular illustrative embodiment of the invention showing a rotary storage organizer.
Figure 2:
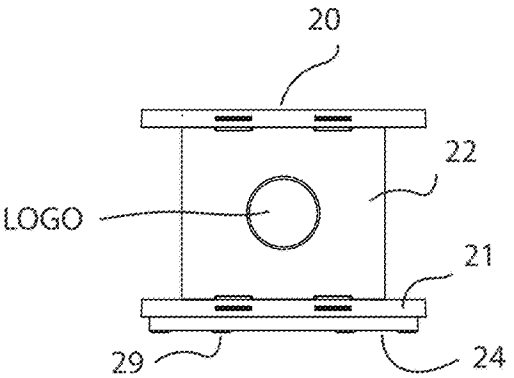
FIG. 2 shows a left and right end view of a particular illustrative embodiment of the invention.

FIG. 1 and FIG. 2 show a particular illustrative embodiment of the invention, showing an isometric view of a new and improved "Lazy Susan" type organizer. Top shelf 20 and bottom shelf 21 are supported by end caps 22 and 23 respectively. A ball bearing plate 24 and eight ball bearings 26 allow the storage unit to rotate. To increase capacity and rigidity a wave-shaped center partition 25 interlocks and holds top shelves 20 and 21 and also end caps 22 and 23.

Figure 3:
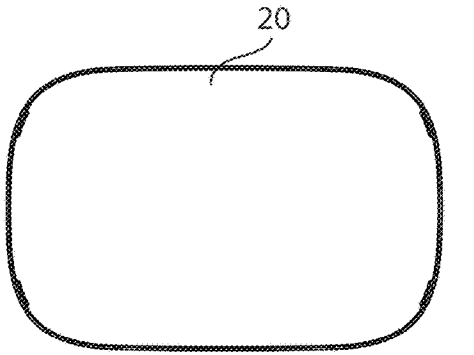
FIG. 3 shows a top view of a particular illustrative embodiment of the invention.

FIG. 3 shows a top view of the organizer's top shelf 20 in a particular illustrative embodiment of the invention.

Figure 4:
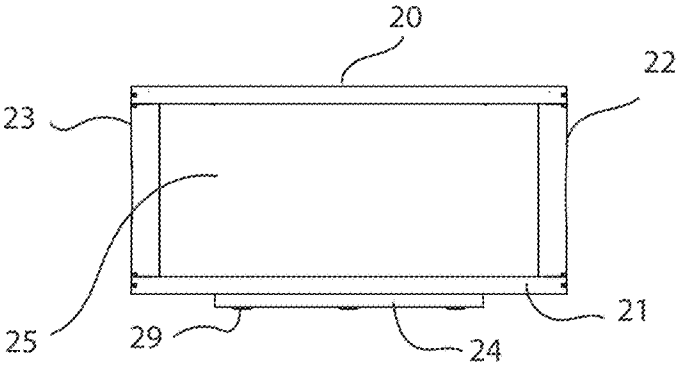
FIG. 4 shows a front and back view of storage unit in a particular illustrative embodiment of the invention.

FIG. 4 shows a front view of the organizer and top and bottom shelves 20 and 21, left and right and caps 22 and 23, wave-shaped center partition 25, ball bearing spinner 24 and eight high-friction foot pads 29 in a particular illustrative embodiment of the invention.

The organizer is specifically designed to fit and spin inside a standard cabinet. No installation is required. The organizer sets and rotates in a position where the unit does not hit the cabinet sides when rotated 360 degrees. To fill the unit, open the cabinet door and place items on the shelves of side one. Rotate and fill side two. A filled unit will hold approximately 16 soup-sized cans which weigh up to 30 pounds. To hold this much weight a continuous metal band is required. FIG. 14 shows the metal band positioned over a slot in the bottom shelf. FIG. 16 shows the metal band after being pressed into position. Both top shelf 20 and bottom shelf 21 have a continuous metal band 30 attached to add strength and to prevent plastic creep over time.

Disclosed is a new and improved rotary organizer. It has a front and back storage compartment 180 degrees apart. The unit fits most standard kitchen cabinets. It needs no installation. Just set the unit inside the cabinet and position so that the front face is flush with the front edge of the cabinet shelf. If there is a lip on the cabinet, push the unit all the way up to the lip. The unit has a magnetic detent so that the unit can be in "rest position". Rest position A is when side one of the unit is at 0 degrees and side two is at 180 degrees. To access side two of the unit, rotate 180 degrees to the next magnetic detent, rest position B. The cabinet door can be closed when the unit is in rest position.

To retrieve a can or bottle from the unit, first open the cabinet door and visually search side one of the unit. If the desired can is not found, then rotate unit 180 degrees in either direction and visually search side two. The unit is heavy duty, and a filled unit will hold over 16 soup-sized cans/bottles that could weigh as much as 30 lbs. A continuous metal band 30 is attached to the perimeter of both top and bottom shelves. The center wave-shaved partition is curved and adds rigidity by connecting the shelves and end caps to the frame. This center partition is also translucent allowing the user to see what is stored on the other side without turning/spinning the unit. The metal bands will prevent plastic creep or bowing after time under load.

Many standard cabinets have a fixed strengthening rib or lip across the front of the cabinet bottom. The cabinet door closes against this rib/lip. This rib/lip is a typical snag point for sliding and rotating organizers. This rib/lip typically is ½ inch high and ¾ in deep. This new and improved unit has a rotating base that will bridge this cabinet rib/lip. Therefore, the rotating base can spin outside the cabinet door for easy access. In a particular illustrative embodiment of the invention, the rotating base is ¾ inch thick so that the rotating storage unit clears the rib/lip of the front of the cabinet bottom.

As shown in FIG. 6, FIG. 7, and FIGS. 8A, 8B and 8C, in a particular illustrative embodiment of the invention, each shelf (top and bottom) contains a thin metal, e.g., steel, continuous loop band 30. Thes metal bands 30 are pressed into the circumference of a perimeter of the top and bottom shelves which in the present example are made of plastic. The strength of the unit is derived from this band and is a function of a cube of the height. This allows the unit to hold an extraordinary amount of weight . . . over 20 lbs. The metal band 30 holds up over time and can accommodate the load when fully loaded with 16 cans. In another particular embodiment of the invention, only the bottom shelf is equipped with the metal band 30.

Figure 5:
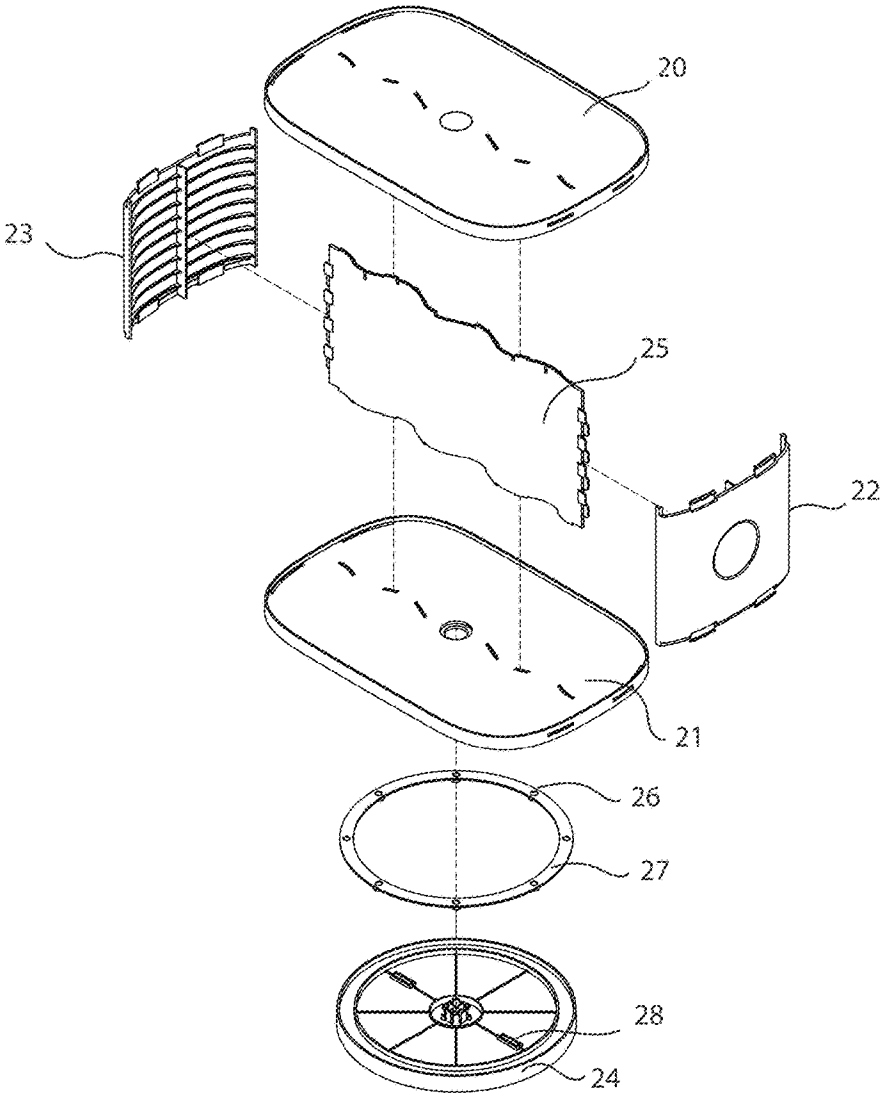
FIG. 5 shows an exploded view of storage unit in a particular illustrative embodiment of the invention.
Figure 6:
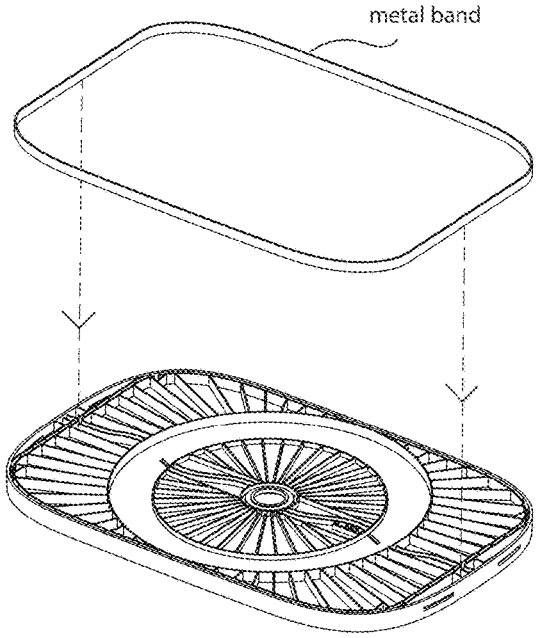
FIG. 6 shows an isometric view of metal band ready to be pressed into a shelf in a particular illustrative embodiment of the invention.
Figure 7:
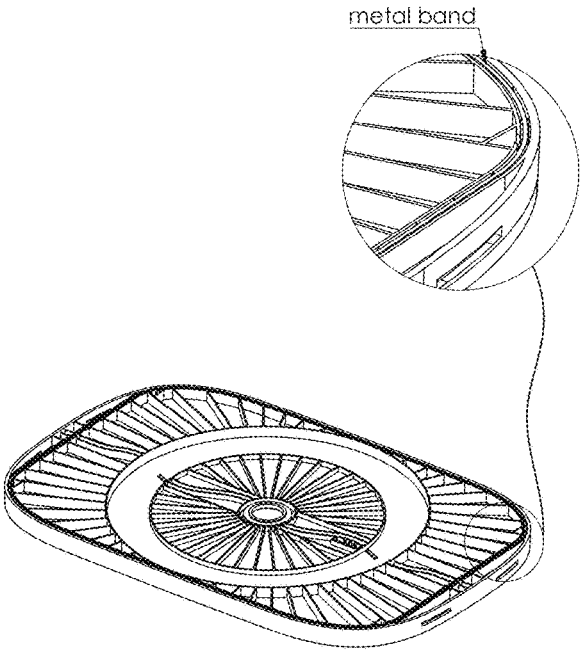
FIG. 7 shows an isometric view of the metal band pressed into shelf slot in a particular illustrative embodiment of the invention.
Figure 8A:
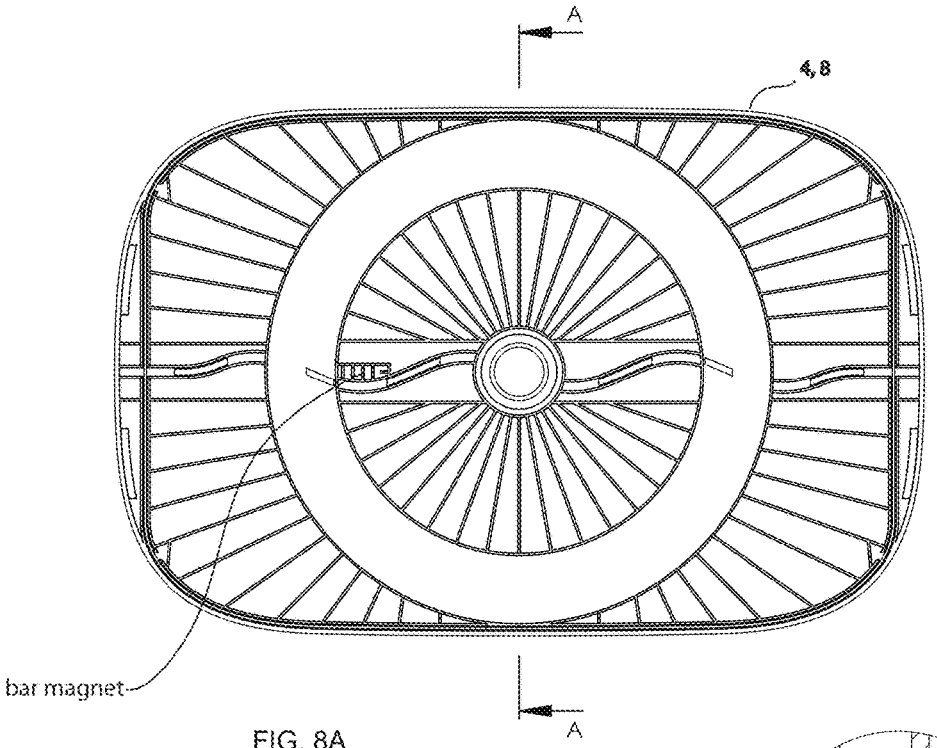
FIGS. 8A, 8B and 8C show section views of bar magnets and ball bearing track in a particular illustrative embodiment of the invention.
Figure 8B:
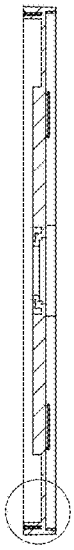
Figure 8C:
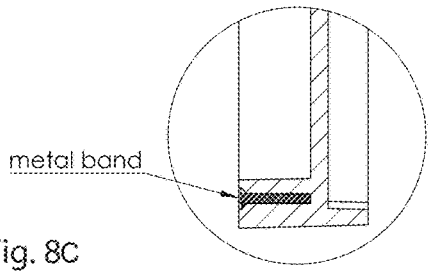

As shown in FIG. 5, in a particular illustrative embodiment of the invention, a wave-shaped center partition (25) is shaped this way to add addition strength. It is also made a clear polymer so you can see through to the other side and see items stored without having to rate the unit around. The wave shape accommodates the circular shape of stored canned goods so that canned goods on each side of the partition fit next to inside the wave-shaped partition as shown in FIGS. 11A and 11B, section B-B.

Figure 10:
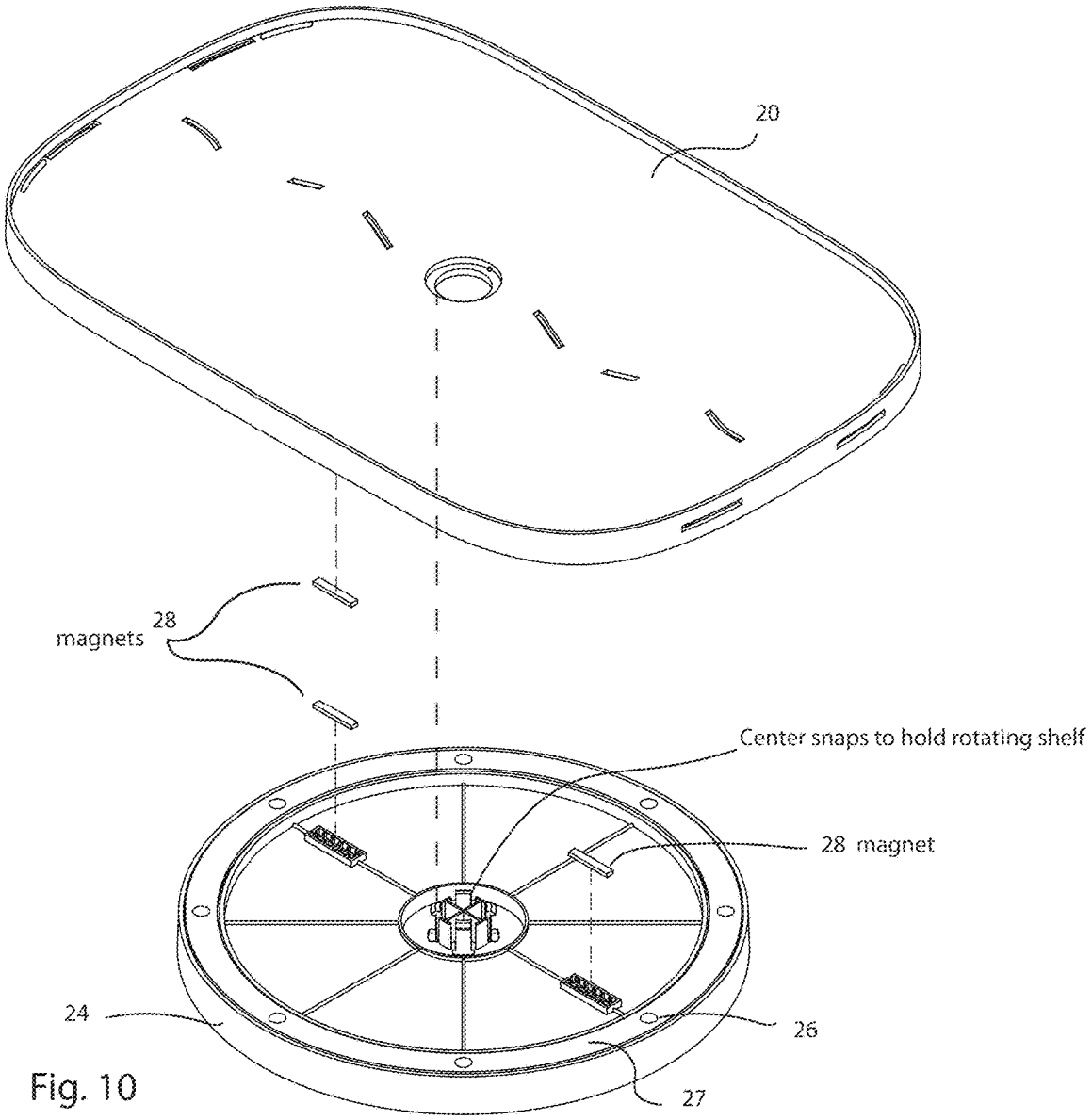
FIG. 10 shows an exploded view of ball bearing base in a particular illustrative embodiment of the invention.

As shown in FIG. 10, magnets 28 are placed in the bottom shelf and base 24 to hold the rotating bottom shelf 20 in place on the base. A center snap 35 is provided to hold the rotating bottom shelf 20.

As shown in FIGS. 11A and 11B-Section B-B, in a particular illustrative embodiment of the invention, the center, wave-shaped partition also allows cylindrical items to nest within the waves to
maximize storage. The shape closely matches a typical can of soup.

In a particular illustrative embodiment of the invention, as show in FIG. 10 and FIGS. 9A, 9B, 9C and 9D—magnets 31 are located in the bottom base allows it to rotate 180 degrees from the front and back position (home position). The magnets create a detent to stop the unit from rotating and face parallel to the front of the cabinet for easy visibility and access.

In a particular illustrative embodiment of the invention, as shown in FIGS. 12A, 12B, 12C, 12D, 12E and 12F and FIGS. 13A, 13B, 13C, 13D, 13E and 13F.

Figure 12:
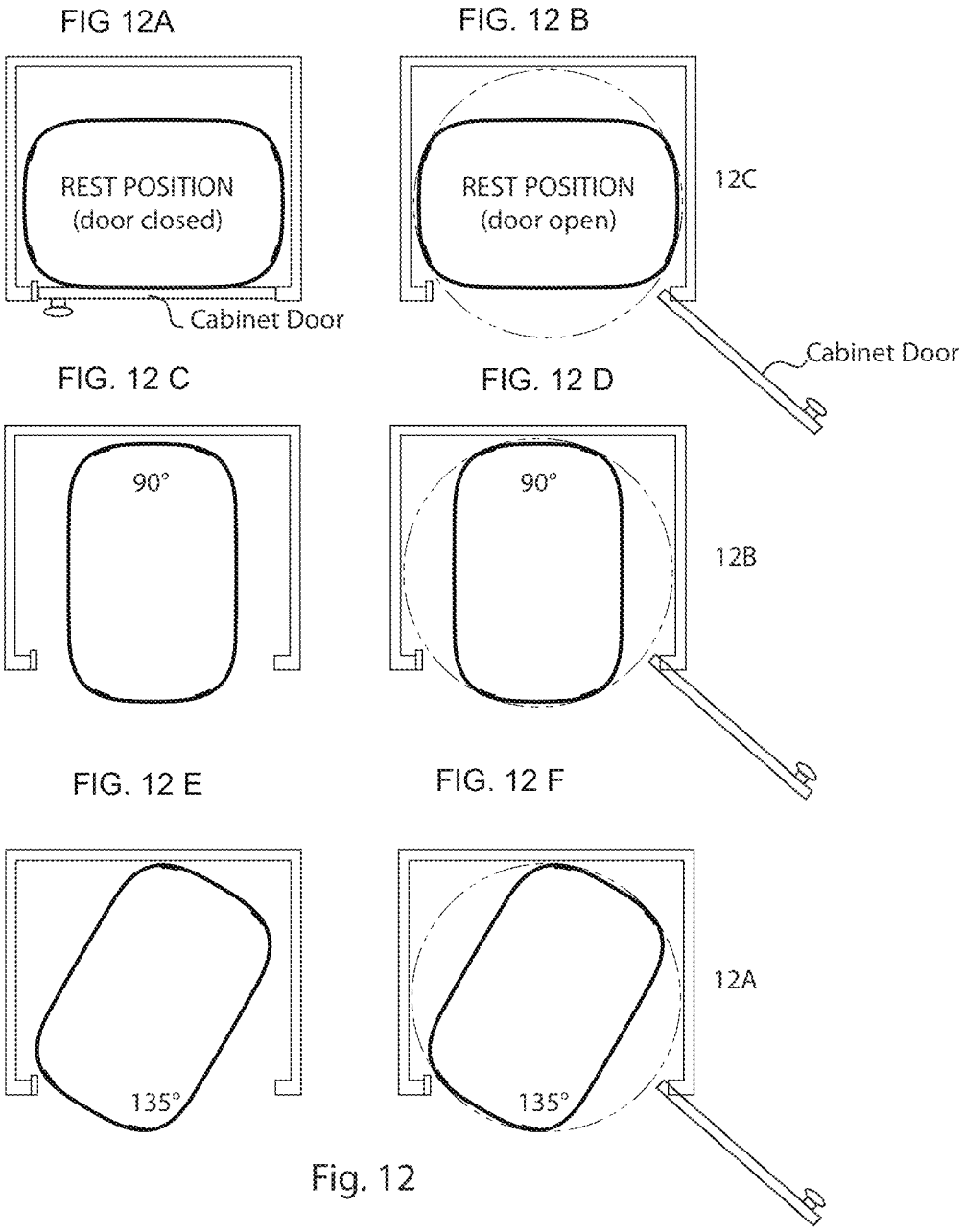

FIG. 12A shows the rectangular storage unit in home position (lengthwise) with the door closed. When the door is open (FIG. 12C) the home position does not change. The unit sits to the front of the kitchen cabinet instead of the back. With the kitchen cabinet open, you can rotate the rectangular unit (12B) and the sides of the unit protrude and swing out over the edge of the open cabinet. However, because the unit sits to the front, in a standard kitchen cabinet (10.75 inches deep) the unit is able to clear the back of the cabinet. In fact, the clearance only needs to be 10.375 inches. Almost all past organizers have been pushed to the back of the cabinet or wall. In a particular illustrative embodiment of the invention, the rotatory organizer storage cabinet is positioned to the front edge of the kitchen cabinet next to the cabinet door. The edges of the rotary storage organizer shelves are also radiused so that as it rotates, the unit will not hit the sides of the storage cabinet.

Disclosed is a new and improved rotary organizer. It has a front and back storage compartment 180 degrees apart. The unit fits most standard kitchen cabinets. It needs no installation. Just set the unit inside the cabinet and position so that the front face is flush with the front edge of the cabinet shelf. If there is a lip on the cabinet, push the unit all the way up to the lip. The unit has a magnetic detent so that the unit can be in "rest position". Rest position A is when side one of the unit is at 0 degrees and side two is at 180 degrees. To access side two of the unit, rotate 180 degrees to the next magnetic detent, rest position B. The cabinet door can be closed when the unit is in rest position.

To retrieve a can or bottle from the unit, first open the cabinet door and visually search side one of the unit. If the desired can is not found, then rotate unit 180 degrees in either direction and visually search side two.

The unit is heavy duty, and a filled unit will hold over 16 soup-sized cans/bottles that could weigh as much as 30 lbs. A continuous metal band is attached to the perimeter of both top and bottom shelves. The center wave-shaved partition is curved and adds rigidity by connecting the shelves and end caps to the frame. This center partition is also translucent allowing the user to see what is stored on the other side without turning/spinning the unit. The metal bands will prevent plastic creep or bowing after time under load.

Many standard kitchen cabinets have a fixed strengthening rib or lip across the front of the cabinet bottom. The cabinet door closes against this rib/lip. This rib/lip is a typical snag point for sliding and rotating organizers. This rib/lip typically is ½ inch high and ¾ in deep. This new and improved unit has a rotating base that will bridge this cabinet rib/lip. Therefore, the rotating base can spin outside the cabinet door for easy access. That is the rotating base is ¾ high so that the rotating base is higher than and clears the front lip across the kitchen cabinet bottom.

The invention claimed is:

1. A rotary storage organizer, comprising:

a rotating base configured for placement inside a kitchen cabinet, wherein the kitchen cabinet has a front side and a back side;

a first shelf having a front side and a back side wherein the first shelf is attached to the rotating base, wherein canned good shaped items are adapted to be placed on the shelf for storage inside the kitchen cabinet, wherein the shelf is configured to be rotatable on the rotating base so that the front side of the shelf is rotatable away from the front side of the kitchen cabinet to the back side of the kitchen cabinet and adapted so that the canned good shaped items placed on the back side of the shelf are visible from the front side of the kitchen cabinet; and a load-bearing wave-shaped partition configured to snap into a longitudinal center of the first shelf.

2. The rotary storage organizer of claim 1, further comprising:

a second shelf, wherein the first shelf forms a bottom shelf and the second shelf forms a top shelf of the rotary storage kitchen cabinet organizer.

3. The rotary storage organizer of claim 1, wherein the first shelf is configured in a substantially rectangular oblong shape, wherein the first shelf is adapted so that the first shelf fits inside of a kitchen cabinet front of the kitchen cabinet when a side of the oblong shape of the first shelf is substantially parallel to a kitchen cabinet front of the kitchen cabinet.

4. The rotary storage organizer of claim 3, wherein the first shelf protrudes beyond the kitchen cabinet front of the kitchen cabinet when a long side of the first shelf is substantially perpendicular to the kitchen front of the kitchen cabinet.

5. The rotary storage organizer of claim 4, wherein the first shelf has rounded corners that enable the first shelf to rotate out of the kitchen cabinet without hitting the kitchen cabinet.

6. The rotary organizer of claim 1, wherein the load-bearing wave-shaped partition is clear and adapted so that goods stored on the back of the shelf are visible through the partition from the front of the rotary storage kitchen cabinet organizer.

7. The rotatory storage organizer of claim 1, further comprising:

a metal band pressed into a circumference of a peripheral edge of the first shelf, wherein the metal band adds strength to the first shelf.

8. The rotary storage organizer of claim 1, further comprising:

a second shelf that is configured as a top shelf, wherein the partition attaches between the top shelf and a bottom shelf to add strength to the rotary storage kitchen cabinet organizer.

9. The rotary storage organizer of claim 8, further comprising:

a first end cap attached to a first end of the top shelf and the bottom shelf, and a second end cap attached to a second end of the top shelf and the bottom shelf.

10. The rotary storage organizer of claim 9, wherein the partition attaches to the first and second end caps.

11. The rotary storage organizer of claim 10, further comprising:

a magnet configured to magnetically hold the bottom shelf in place substantially parallel to the kitchen cabinet front of the kitchen cabinet.

12. The rotary storage organizer of claim 1, wherein the wave-shaped partition is configured in a shape that accommodates canned good-shaped items, wherein the wave-shaped partition is adapted so that the canned good-shaped items fit curved shaped indentions in the partition so that canned good-shaped items on each side of the wave-shaped partition fit inside of the partition and adapted to allow the items to nest within the indentions.

13. The rotary storage organizer of claim 1, wherein the first shelf is configured to provide a clearance between the first shelf and the kitchen cabinet required to rotate the first shelf inside of the kitchen cabinet.

14. The rotary storage organizer of claim 13, wherein the rotary storage organizer is configured to provide clearance for the rotary storage organizer as the rotary storage organizer is 10.375 inches wide and the kitchen cabinet is 10.75 inches deep.

15. The rotary storage organizer of claim 9, wherein the first end cap and the second end cap are curved to provide clearance within the cabinet for rotating the rotary storage organizer.

* * * * *